US011602485B2

(12) United States Patent
Nicholls

(10) Patent No.: US 11,602,485 B2
(45) Date of Patent: Mar. 14, 2023

(54) METHOD OF STIMULATING HAIR GROWTH

(71) Applicant: Bountifulair Pty Ltd, Cheltenham (AU)

(72) Inventor: Deborah Nicholls, Cheltenham (AU)

(73) Assignee: BOUNTIFULAIR PTY LTD, Cheltenham (AU)

( * ) Notice: Subject to any disclaimer, the term of this patent is extended or adjusted under 35 U.S.C. 154(b) by 569 days.

(21) Appl. No.: 16/465,713

(22) PCT Filed: Dec. 4, 2017

(86) PCT No.: PCT/AU2017/051330

§ 371 (c)(1),
(2) Date: May 31, 2019

(87) PCT Pub. No.: WO2018/098535

PCT Pub. Date: Jun. 7, 2018

(65) Prior Publication Data

US 2019/0336391 A1 Nov. 7, 2019

(30) Foreign Application Priority Data

Dec. 2, 2016 (AU) ..... 2016266077

(51) Int. Cl.
*A61H 99/00* (2006.01)

(52) U.S. Cl.
CPC ..... *A61H 99/00* (2013.01); *A61H 2201/0153* (2013.01); *A61H 2201/0157* (2013.01);
(Continued)

(58) Field of Classification Search
CPC . A61H 7/00; A61H 7/01; A61H 39/04; A61H 2201/06; A61H 2205/021;
(Continued)

(56) References Cited

U.S. PATENT DOCUMENTS 4,744,350 A * 5/1988 Sato ..... A61H 15/0092 601/1
6,911,013 B2 6/2005 Heimberger
(Continued)

FOREIGN PATENT DOCUMENTS

CN 101530370 A1 9/2009
WO 98/51182 A1 11/1998
WO 2011/003156 A1 1/2011

OTHER PUBLICATIONS

Office Action received in Canadian Application No. 3,045,701 dated Sep. 16, 2019.
(Continued)

*Primary Examiner* — Philip R Wiest
*Assistant Examiner* — Nathan M Le
(74) *Attorney, Agent, or Firm* — Ajay A. Jagtiani; Miles & Stockbridge P.C.

(57) ABSTRACT

A method of stimulating hair growth on the scalp of a person's head using a device having a handle and a blade means, the method including the steps of: contacting the blade means on a first area of the scalp; moving the blade means in a continuous reciprocating motion on the scalp in a first direction and an opposite second direction for a first period of time to exfoliate skin on the first area, wherein the blade means remains in continuous contact with the scalp during the reciprocating motion until hair growth is detected in the first area.

22 Claims, 14 Drawing Sheets

(52) U.S. Cl.
CPC ..... *A61H 2201/1607* (2013.01); *A61H 2201/1638* (2013.01); *A61H 2201/1669* (2013.01); *A61H 2201/1695* (2013.01); *A61H 2205/021* (2013.01)

(58) Field of Classification Search
CPC .. A61H 15/0085; B26B 21/00; B26B 21/125; A61M 2037/0007; A45D 26/0028; A45D 24/00; A61N 1/326
See application file for complete search history.

(56) References Cited

U.S. PATENT DOCUMENTS

2014/0213944 A1* 7/2014 Kojima ..... A61H 7/007 601/137
2018/0326208 A1* 11/2018 Ingman ..... A61N 1/0502

OTHER PUBLICATIONS

Search Report received in PCT Application No. PCT/AU2017/051330 dated Feb. 15, 2018.

* cited by examiner

METHOD OF STIMULATING HAIR GROWTH

FIELD OF THE INVENTION

This invention relates to a method for stimulating hair growth and more particularly to a method for stimulating hair growth on the head of a person.

BACKGROUND OF THE INVENTION

Hair loss, also known as alopecia or baldness, is the loss of hair particularly from the head of a person. It can be due to a number of causes, such as androgenetic alopecia, trauma, radiotherapy, chemotherapy, iron deficiency or other nutritional deficiencies, autoimmune diseases and fungal infection. Alopecia areata is an auto-immune disease that can cause hair to fall out suddenly. It leads to bald patches on the scalp or other parts of the body. Hair growth in the affected hair follicles is reduced or completely ceases.

Various types of treatment have been attempted for hair loss over the years including hair transplantation. This involves transplanting hair from areas of the scalp, where hair is growing, to bald patches or bald areas of the scalp. This is a very expensive and painful process for patients and can take a very long time. Other less successful approaches have been tried including medical treatments. Of these, the most commonly used chemical products to treat male hair loss have been finasteride, dutasteride and minoxidil. Minoxidil, in particular, has had some limited success in helping promote growth of hair in both males and females having androgenic alopecia. It is applied topically. Other treatments include radiation induced hair loss, cosmeses which is the use of shampoos and ointments to visually thicken existing hair, and alternative medicines have been tried but not effectively proven to regrow hair or retain hair. Laser therapy has also been tried as well as dietary supplements, which are not particularly recommended and have had limited success.

The present invention seeks to provide a method for stimulating the growth of hair to increase the amount of hair in bald areas particularly on the scalp of a person.

SUMMARY OF THE INVENTION

According to a first aspect of the invention, there is provided a method of stimulating hair growth on a person's head using a device having a handle and a blade means, the method including the steps of:

moving the blade means in a first direction and an opposite second direction on an area of the head to be treated for a period of time; and repeating said moving step at least once at a subsequent time for a further time period.

In an embodiment, the invention provides a method of stimulating hair growth on a person's head using a device having a handle and a blade means, the method including the steps of:

moving the blade means in a first direction and an opposite second direction on a first area of the head to be treated continuously for a period of time; and repeating said moving step at least once at a subsequent time until hair grows through skin of the person's head and the growth of said hair is detectable, wherein the total time of said period of time and said at least one subsequent time is at least 8 hours.

In a second aspect of the invention, there is provided a method of stimulating hair growth on the scalp of a person's head using a device having a handle and a blade means, the method including the steps of:

contacting the blade means on a first area of the scalp;

moving the blade means in a continuous reciprocating motion on the scalp in a first direction and an opposite second direction for a first period of time to exfoliate skin on the first area, wherein the blade means remains in continuous contact with the scalp during the reciprocating motion until hair growth is detected in the first area.

The method may include repeating the moving step for a second period of time, wherein the total time of the first and second periods of time is at least 8 hours. For example, the first time period is 2 hours and the second time period is 6 hours. In another example, the first and second time periods are 6 hours.

The minimal duration of either the first or second time periods is 1 hour. Suitably, the minimal duration of either the first or second time periods is 2 hours.

The method may include a rest period between the first and second periods of time. Alternatively, the first and second periods of time are continuous.

Hair growth may be determined by detecting shoots of new hair appearing in said first area. In this method, hair growth is confirmed when tips of the new shoots appear on the treatment area (e.g. the first area).

Hair growth may also be determined by measuring an increase in length of the hair follicles. Hair growth may also be determined by measuring a change in the hairline or foreline. Suitably, the change in the hairline is determined by measuring the change in distance between any point on the hairline and the browline of the person's head.

Without being bound by theory, it is believed that a reason for hair loss is due to the presence of damaged or cracked skin on a person's scalp blocking the growth of hair follicles. It is believed that hair growth may be stimulated by either or both (i) improving blood circulation around the hair follicles and (ii) removing skin segments or exfoliating skin covering the hair follicles. Either or both these actions allow(s) the hair follicles to breathe and the hair to break through the skin of the scalp to stimulate hair growth.

Moving the blade means in the first and second reciprocating directions may improve blood circulation for several reasons including (i) generating friction on the first area to increase surface temperature which causes dilation of the blood vessels and (ii) generating pressure and/or movement on the skin in the first area which increases blood flow to the area.

When the treatment area (e.g. first area) of the head reddens due to blood circulation, the moving step is preferably performed in a further area of the head. The method may further include positioning the blade means at an angle of between 40 degrees and 60 degrees with respect to a plane generally tangential to the surface of the area of the head where the blade means contacts the surface. Suitably, the blade is positioned at an angle of about 45 degrees.

The area of the head to be treated may be bald or may have thinning hair. In this specification, thinning hair is defined by any region on a person's head in which the scalp is visible through the hair. Thinning hair also has a lower hair density relative to other regions on the person's head.

The treatment area may have a width equal to the width of the blade means. The treatment area can be up to one square inch. Suitably, the treatment area is up to one square inch in width.

The method may further include performing said moving step on another area of said head when shoots of new hair growth appear in said first area. The blade means may be a razor and more particularly a disposable razor.

The moving step may involve dragging the blade means in the first direction across the scalp of a person's head, and pushing the blade means against the scalp of a person's head in the second opposing direction. The dragging action may occur by moving the non-cutting edge of the blade means across the scalp of a person's head and the pushing action occurs by moving the cutting edge of the blade means across the scalp of the person's head.

During the moving step, existing hair may be removed, such as through cutting or shaving by the cutting edge, from the person's head. It is believed that this does not adversely affect the stimulation of hair growth in the treatment area.

During the moving step, skin segments or skin covering the hair follicles may be exfoliated from the person's scalp.

The movement in the first direction preferably drags the blade means across the surface at an angle between 40 degrees and 60 degrees, and the movement in the second direction is such that the blade means is pushed against the surface at substantially the same angle. The blade means is preferably linear and said first direction and said second direction are preferably substantially orthogonal to the linear direction of the blade means.

In another embodiment, the moving step involves pushing the blade means against the scalp of a person's head in the first direction and dragging the blade means in the second direction across the scalp of a person's head.

In another embodiment, the moving step may involve dragging the blade means in both first and second directions across the scalp of the person's head.

In a further embodiment, the moving step may involve pushing the blade means against the scalp of a person's head in both first and second directions.

During the moving step, the first and second directions may be reversed to minimise slippage of the blade means on the scalp.

The first direction may be an upward movement of the blade means towards the top of the person's head and the second direction is a downward movement of the blade means towards the nape of the person's head.

The distance travelled by the blade means in the first direction may be the same as the distance travelled by the blade means in the second direction.

The method may include applying a pressure when moving the blade means in the first and second directions that is sufficient to remove skin segments or exfoliate skin from the person's scalp without breaking skin to cause bleeding.

The method may include a step of replacing the blade means. Suitably, the blade means are replaced before the method or moving step is repeated.

According to a third aspect of the invention, there is provided a device to stimulate hair growth on a person's head comprising a body having a top side and a bottom side, and a handle portion located between the top and bottom sides, the top side including a viewing means and the bottom side including a blade means to contact and exfoliate skin on the first area of the person's head to stimulate hair growth, the handle includes a grip to accommodate fingers of a user, wherein the blade means includes an edge which contacts the person's head to stimulate hair growth and the viewing means enables the hair growth to be determined while the blade means is stimulating hair growth.

The device may be used to perform the previously described method of stimulating hair growth.

The grip of the handle allows a user to perform the previously described method of stimulating hair growth by holding the device in two different ways. In the first way, the grip and the handle are gripped by the user. In the second way, only the grip is held by the user. This allows the user to control the amount of strength required to perform the method. Suitably, the grip comprises a plurality of rings to accommodate the fingers of a user.

The blade means may be rotatable about the body to change the direction of the blade. Suitably, the blade means is rotatable at 90 degree intervals about the body. This provides a device that is adjustable for use by a left or right handed person. The adjustable blade also minimises the need for the user to adjust the orientation of the device as different areas of the person's scalp are treated.

The viewing means may be a magnifying glass.

The viewing means may be snap fitted into the body. This may allow the viewing means to be positioned in the same direction as the blade means without rotation of the viewing means about the body.

The blade means may include two or more blades. This may enhance hair growth by providing multiple points of contact with the person's head.

The blade means may possess any one of the following edge types: symmetrical "V", asymmetrical "V", convex, concave, compound double bevel or chisel.

The blade means may include an indicator to indicate the direction of the blade. Suitably, the indicator indicates the direction of the cutting edge of the blade.

The blade means may include a holder to position the blade at an angle of between 40 degrees and 60 degrees from the end of the holder. Suitably, the holder positions the blade at an angle of about 45 degrees from the end of the holder.

According to a fourth aspect of the invention, there is provided a method of using the device as previously described to stimulate hair growth on a person's head including:

holding the handle portion of the device by engaging a user's fingers with the grip of the handle portion;

moving the blade means in a continuous reciprocating motion on the scalp in a first direction and an opposite second direction on a first area of the head to be treated for a period of time;

observing the first area of the head using the viewing means to detect hair growth while moving the blade means in the continuous reciprocating motion; and repeating the moving step for a second period of time, wherein the total time of the first and second periods of time is at least 8 hours until hair growth is detected.

The method may include rotating the blade means about the body to change the direction of the blade.

BRIEF DESCRIPTION OF THE DRAWINGS

Preferred embodiments will hereinafter be described, by way of example only with reference to the drawing in which.

DETAILED DESCRIPTION OF THE PREFERRED EMBODIMENTS

Figure 1:
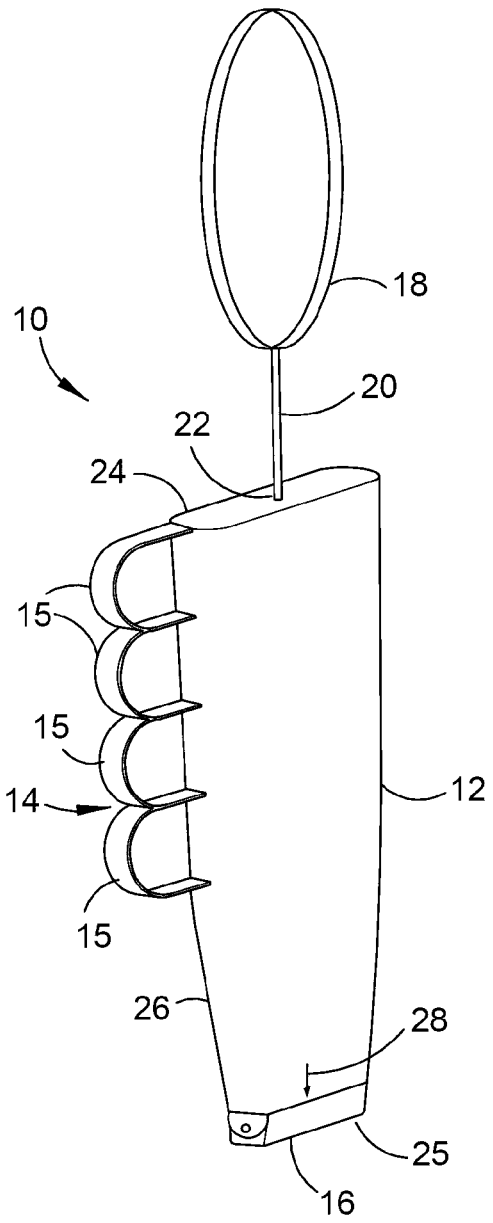
FIG. 1 is a perspective view of a device used to perform the method of stimulating hair growth.

Referring to FIG. 1 there is shown a device 10 that is used to promote or stimulate hair growth on a person's head 30 and in particular a person's scalp 32. The device 10 can be a blade means with a handle, such as a disposable razor. The device of FIG. 1 has a main body 12 having a top side 24, a bottom side 25 and a handle means 14 located on side 26. The handle means 14 is specifically designed for insertion by a set of fingers of a user where there are portions 15 to enable up to four fingers of a user's hand to be able to grip the device 10. It can be either used as a left-handed device or a right-handed device where, for example as a right-handed device, the four fingers of the user will protrude through the portions 15 and the palm of the right hand will be gripped on a rear side of the body 12. Extending from the top side 24 is a viewing means 18 in the form of a magnifying glass that has a shaft 20 that can be adapted to be engaged and disengaged from the top side 24 at the joint 22 by snap fitting. Located at the bottom side 25 of the body 12 is a blade means 16 that has an indicator 28, being an arrow, for indicating the direction of the blade. The bottom side 25 can be twisted to the right for a right-handed person or twisted to the left for a left-handed person. Suitably, the bottom side is rotatable at 90 degree intervals. The device 10 can be made from a suitably strong, long-lasting and light weight material such as titanium or aluminium.

Figure 2:
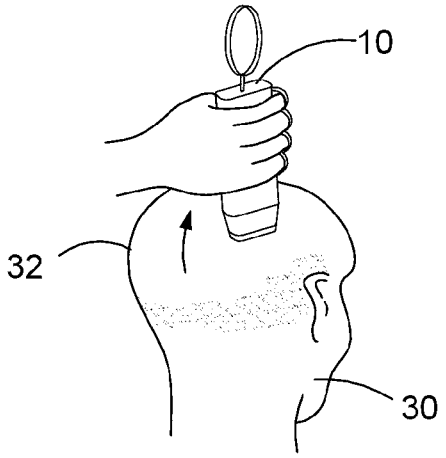
FIG. 2 is a perspective view of a user using the device of FIG. 1 on a person's head in an upward direction across the surface of the person's scalp.
Figure 3:
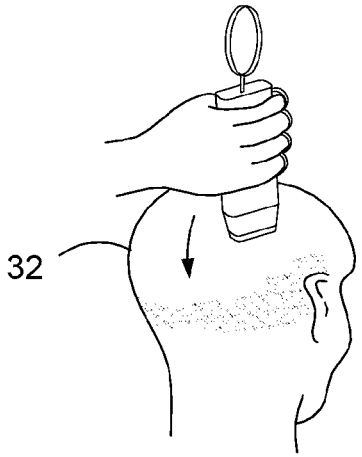
FIG. 3 is a perspective view similar to FIG. 2 except that the device is used in a downward direction across the surface of the person's scalp.
Figure 4:
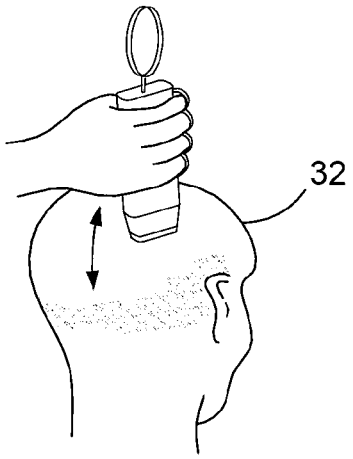
FIG. 4 is a view similar to FIGS. 2 and 3 however using the device of FIG. 1 in an upward and downward continuous motion across the surface of the person's scalp.

Referring to each of FIGS. 2 to 4, the blade means 16 of the device 10 or a razor is used in an up and down reciprocating motion, that is first and second directions where the second direction is opposite to the first direction, in separate areas, up to a square inch at a time, on completely bald areas of the scalp 32 or where hair is not visible. Thus, the blade should be moved about an inch in one direction (either up/down or forward/back) and then return an inch in the opposite direction. The up/down or forward/backward motion should be directed towards the crown of the head. The blade means 16 can be arranged as one or more blades placed horizontally with respect to each other with a gap in between each blade. The blades are to be applied to the surface of the scalp 32 in either or both directions at an angle in between 40° and 60°, and more particularly at around 45°, with respect to a plane generally tangential to the surface of the scalp 32, where the blade means 16 contacts the surface of the scalp.

When applying the method from behind the patient or the person being worked upon, the blade 16 can be placed on and around the crown, hairline and the foreline. A vertical up and down motion is to be used in an area of about a square inch at a time. Also at the base of the neck, if required, an up and down motion is performed with the blade against the skin and the blades at an angle of between 40 degrees and 60 degrees and the handle facing upwards. If working on or around the crown, if the blade slips from the scalp, then it is facing the wrong way and the direction of the blade should be changed. The amount of pressure applied to the blade needs to be no more than the pressure that a user would apply to a toothbrush when brushing their own teeth such that skin from the scalp can be removed or exfoliated without breaking skin and causing bleeding. The process may be repeated multiple times before hair starts to regrow from the original hair follicles through the skin on the scalp. The blade means 16, preferably being a disposable razor, should be replaced each day or each time when working on a subject. The movement in the first direction drags the blade means 16 across the surface at an angle between 40 degrees and 60 degrees, and the movement in the second direction is such that the blade means 16 is pushed against the surface at substantially the same angle. The blade means 16 is generally linear and the first direction and the second direction are substantially orthogonal to the linear direction of the blade means 16.

After a certain time of applying the blade 16 to one area of the scalp 32 it will become reddened at which time the up and down motion using the blade should be stopped in that area and moved to a different area on the scalp 32. It is believed that the reddening of the scalp is due to the up and down motion stimulating blood circulation around the hair follicles. The reddening of the scalp may also be due to the blade or blades removing the skin segments or exfoliating the skin covering the hair follicles. Existing hair follicles may also be cut or removed during the up and down motion. New growth of hair should appear in one to two days after at least one application of the blade in the area that became red. When the blade is moved over an area that has new shoots of hair protruding through the skin of the scalp, it will be palpable (blade drags against the blade) and audibly perceptible to the person using the blade means, such as a clicking sound. The feeling of frictional drag means that this is the correct way to use the blade means in either direction. An incorrect way to use the blade means would result in slippage over the surface. It is then necessary to work on another area where no hair is visible or the hair is thin. As mentioned previously, the whole process is repeated many times on different areas of the scalp 32 where hair is not visible or where hair is to grow. After many hours and weeks of repeating this technique, the texture of the scalp 32 will change with the new shoots of hair growing through. Up to approximately 40 hours spread over a few weeks can be the time that is spent or needed for the hair to grow in certain areas. Generally the method is performed for between 30 and 60 minutes a day, and up to 5 days a week. However, this can vary from individual to individual depending on the amount of hair loss over the years and the person's age.

Approximately every month, for up to six months, the process should be repeated to improve blood circulation to the scalp, texture, and strength and durability of the hair but also to allow the follicles of the hair to grow closer together in order to achieve thicker hair. The process involves no bleeding, or cutting of the skin on the scalp nor oozing or weeping from the scalp's surface during or after the procedure. There may however be some flakiness of the skin due to exfoliation around the hair follicles in order to allow the hair follicles to breathe and the hair to break through the skin of the scalp. This promotes the hair to break through the surface of the skin and to regrow. There is no medical follow-up that is required after each procedure. A new blade or blade means should be used with use of the method.

In order to thicken thinning hair, the same procedure as described above can apply to areas where the hair is scarce or patchy. This can be done for up to 10 hours, not continuously, and not the 40 or so hours needed for bald or balding hair. After a certain amount of time, a few ingrown hairs may exist. The user simply scratches, using the blade means, across the surface of the hair in order to disperse the built up fluid that surrounds the hair follicle. There is no need to squeeze or pull out the hair follicle. In one or two days the small redness area around the hair follicle will disappear. The same technique above can be used on areas of thin hair without the blade or blades cutting, catching or removing existing hair. The blade or blades tend to slide through the existing hair, however it will remove the weaker strands of hair.

EXAMPLE 1

Figure 5A:
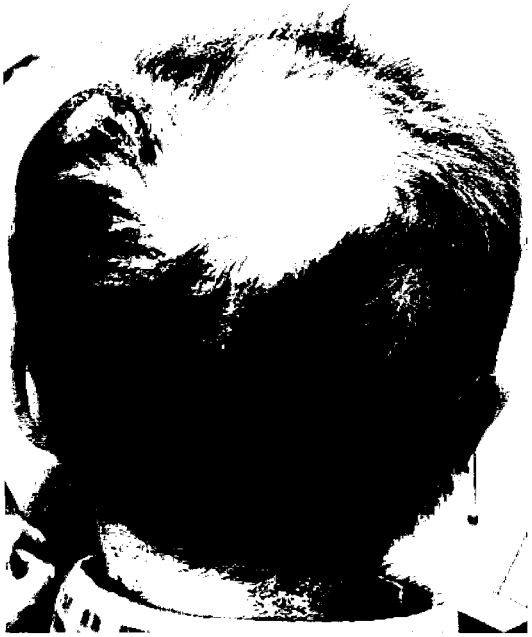
FIGS. 5A to 5C show photographs over a period of time of hair growth on the scalp of a first subject.

An 82 year old is the first subject to undergo the process of the present invention. His scalp was balding in various places as the foreline or hairline had been lost past his crown. The above procedure was commenced on 3 Apr. 2015 and repeated at various intervals on various days for a total period of 9 hours and 5 minutes up until 17 Apr. 2015. The first photograph of FIG. 5A shows a photograph taken on 17 Apr. 2015 from behind and shows the crown of the person. It is seen that some hair has come through around the crown and parts of the scalp forward of the crown.

Figure 5B:
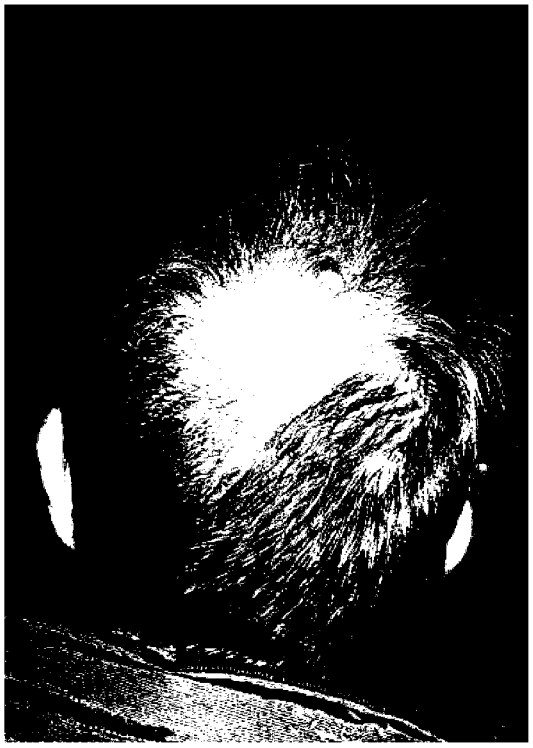

The second photograph in FIG. 5B is taken on 9 May 2015 after a total of 11 hours and 45 minutes work undertaking the process described above. As is seen in the Figure, there is generally a thicker/denser amount of hair around the fore line and crown with newer hair growth coming through immediately around the crown compared to the photograph taken on 17 Apr. 2015 (FIG. 5A).

Figure 5C:
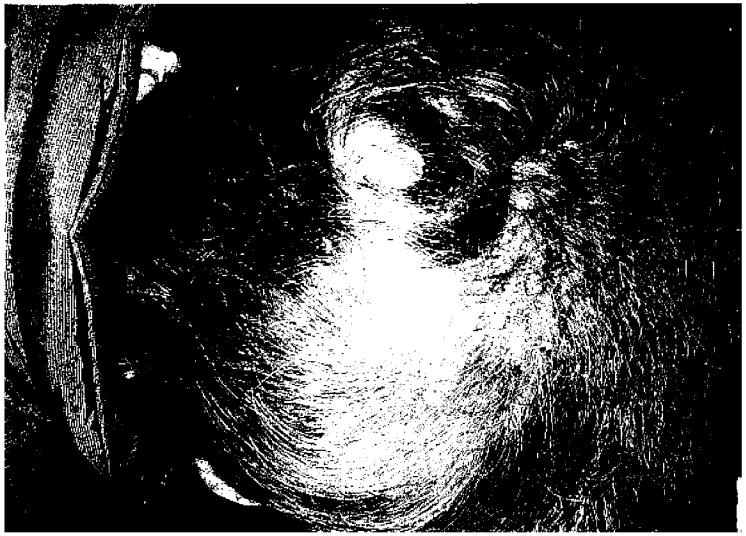

In the third photograph of FIG. 5C this was taken on 4 Jul. 2015 after a total of 18 hours and 45 minutes work. It is clearly seen there is more hair entirely covering the crown and it is thicker/denser such that there is almost no bald patch visible.

EXAMPLE 2

Figure 6A:
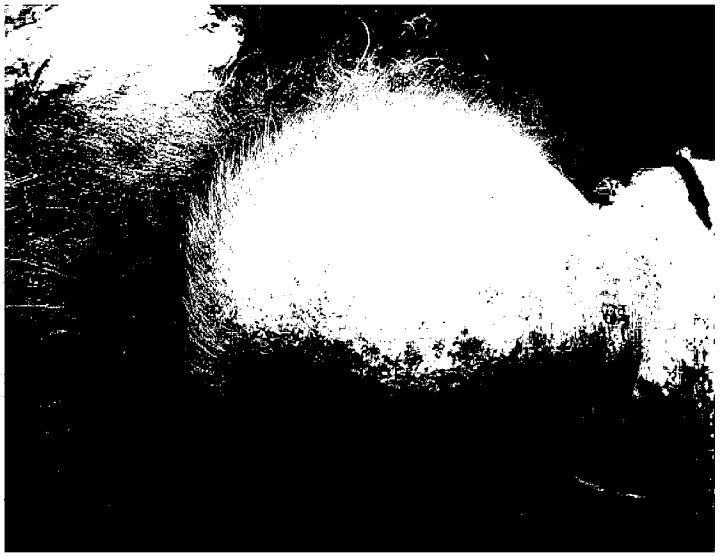
FIGS. 6A to 6E show photographs over a period of time of hair growth on the scalp of a second subject.
Figure 6B:
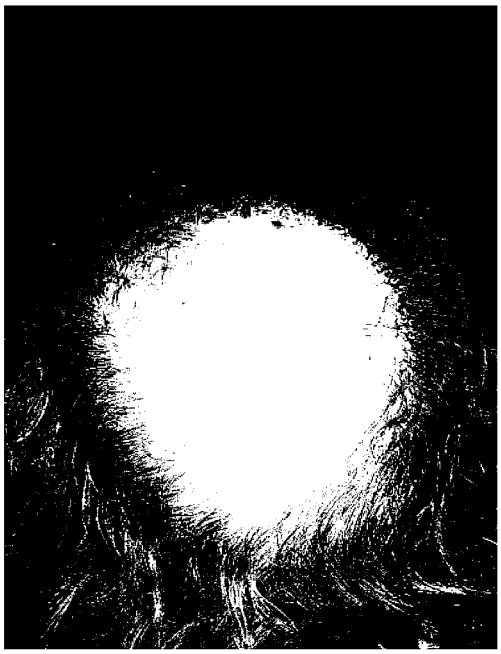
Figure 6C:
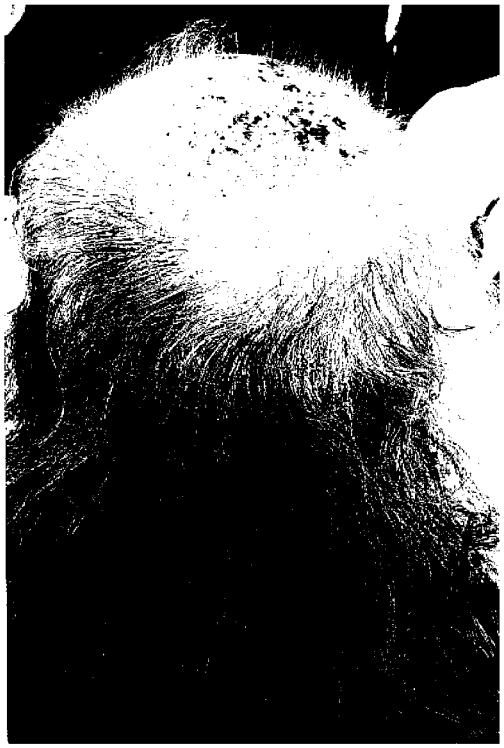
Figure 6D:
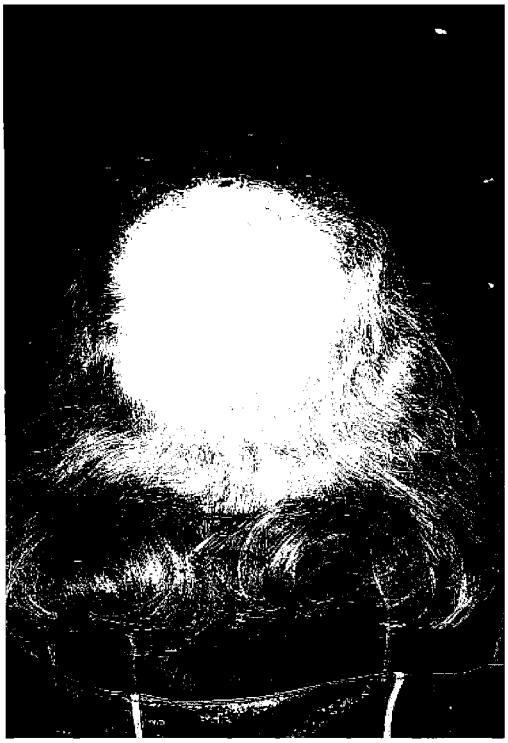
Figure 6E:
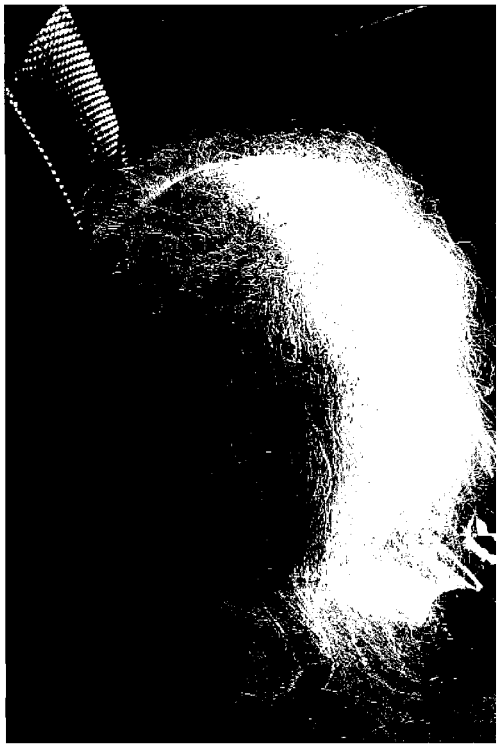

A 63 year old man is the subject of this example. In the first photograph, shown in FIG. 6A, which was taken on 27 Feb. 2016, it shows most of the scalp bald with eczema. A few weeks later in the second photograph of FIG. 6B, which was taken on 21 Apr. 2016, after a total of 35.5 hours of applying the above-described method it shows less eczema on the scalp and also new hair growth below and around the crown as well as on the front portion of the initially bald area. The next photograph in FIG. 6C was taken on 20 Jun. 2016, which shows the hair has completely grown from the previous FIG. 6B that was below and around the base of the crown and has achieved a greater thickness. In the next photograph in FIG. 6D, which was taken on 28 Jul. 2016, with the continued application of the above method, it shows even more hair covering the original bald patch and almost covering the area in front of the crown and down to the hairline. Again there is visibly less eczema. Finally in the last photograph of FIG. 6E, taken on 17 Sep. 2016, it shows a little bit of difference compared to the previous photograph with new hair growth coming through the skin of the scalp.

EXAMPLE 3

A 55 year old male is the subject of this example. A series of photographs in FIGS. 7A to 7J were taken over a period of time from 23 Mar. 2016 to 17 Sep. 2016.

Figure 7A:
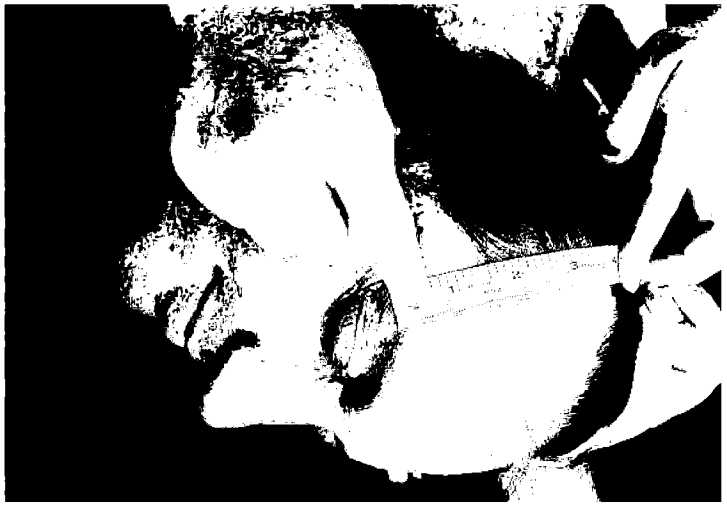
FIGS. 7A to 7J show photographs over a period of time of hair growth on the scalp of a third subject.
Figure 7B:
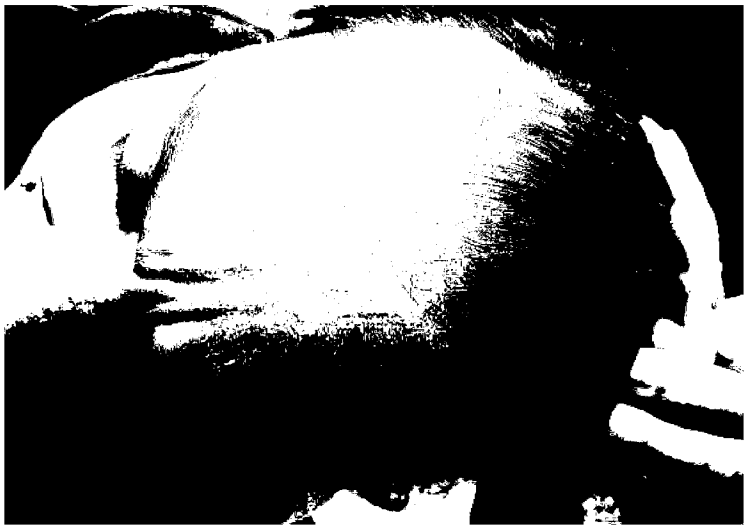
Figure 7C:
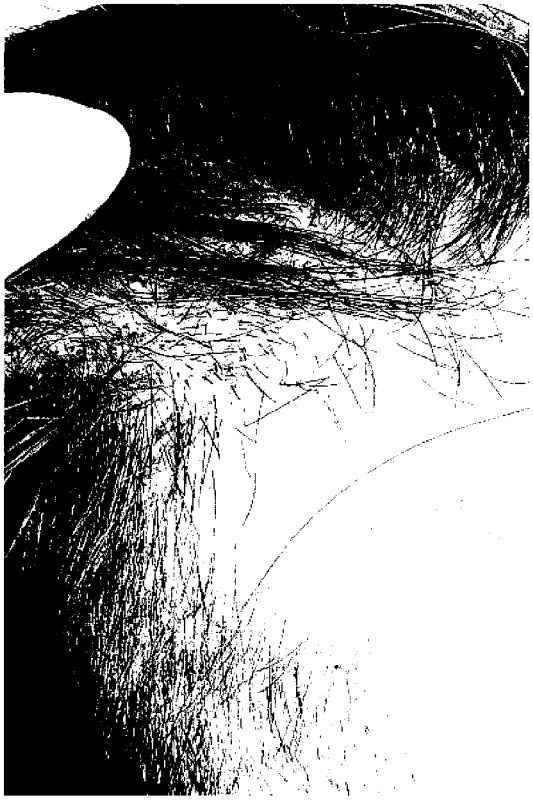
Figure 7D:
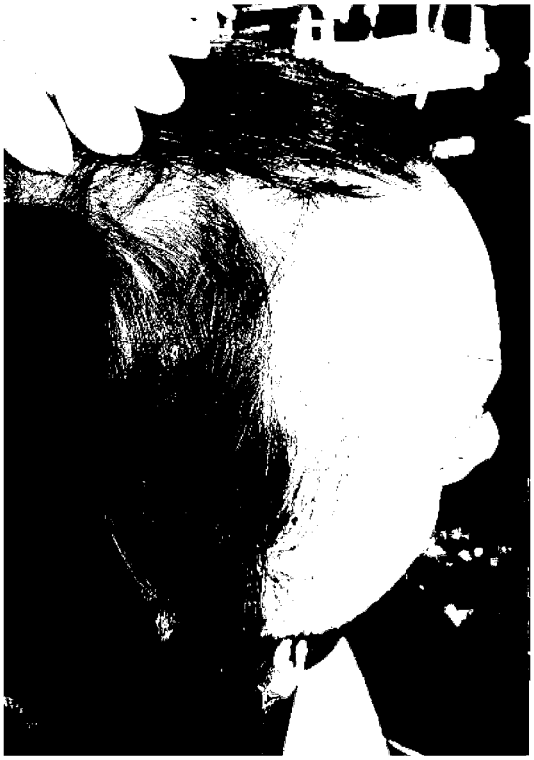

This man had thinning hair on the top of his head with the hair receding on the right side of the foreline by 1 cm more than that compared to the left side foreline. The hair was also thinning between the respective right and left forelines as well as around the crown. The photograph of FIG. 7A was taken on 23 Mar. 2016, prior to any performance of the abovementioned method. It shows a measurement of about 9.5 cm from the top of the right eyebrow to the right foreline where the hair is actually growing. After a total of eight hours of performing the method over a number of weeks the photograph in FIG. 7B was taken on 14 May 2016 which shows that some hair has come through the scalp on the right foreline side. In FIG. 7C there is shown a more magnified view of the foreline shown in FIG. 7B. It clearly reveals hair that has already grown through as well as new shoots of hair protruding through the scalp. The image in FIG. 7D was taken on 20 May 2016 and shows the new shoots shown in FIG. 7C have grown to a longer length and appear thicker.

Figure 7E:
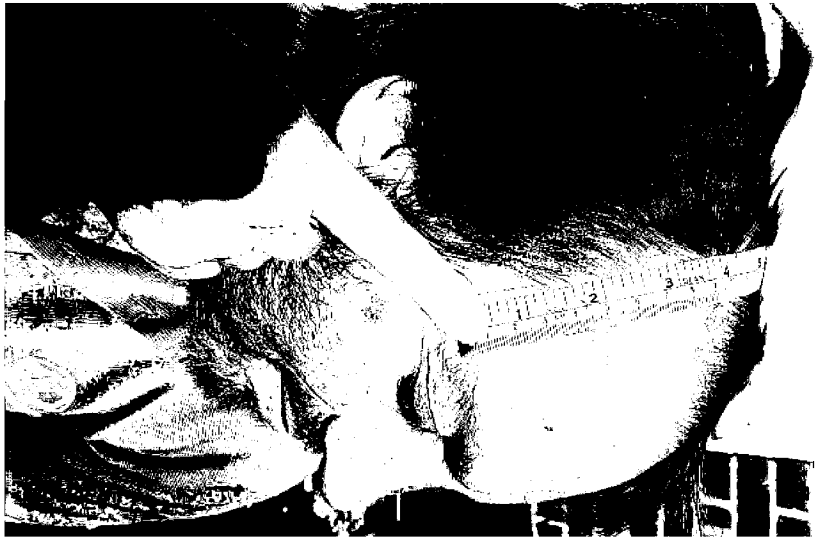

Finally in FIG. 7E, which was taken much later on 17 Sep. 2016, there is shown the growth of hair along the right foreline at about the 8.5-9 cm (on the measuring tape) mark taken from the top of the right eyebrow (i.e. browline). This clearly shows that the application of the method has stimulated hair growth along the right foreline of about 1 cm in width.

Figure 7F:
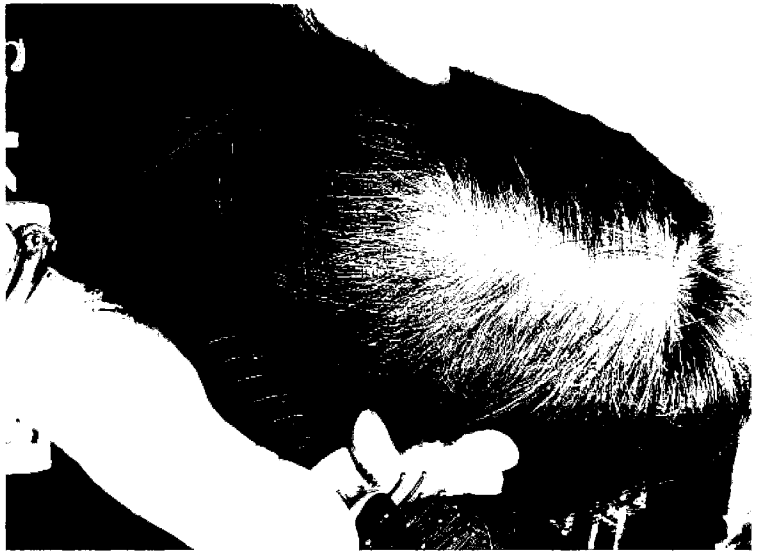
Figure 7G:
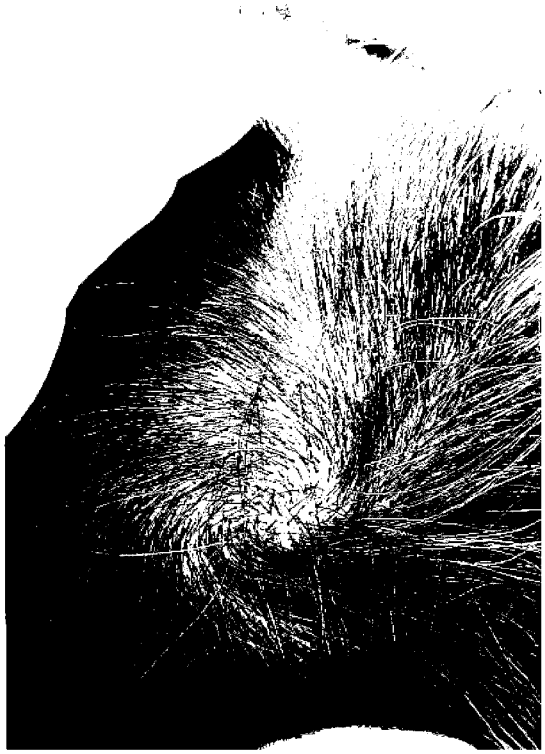
Figure 7H:
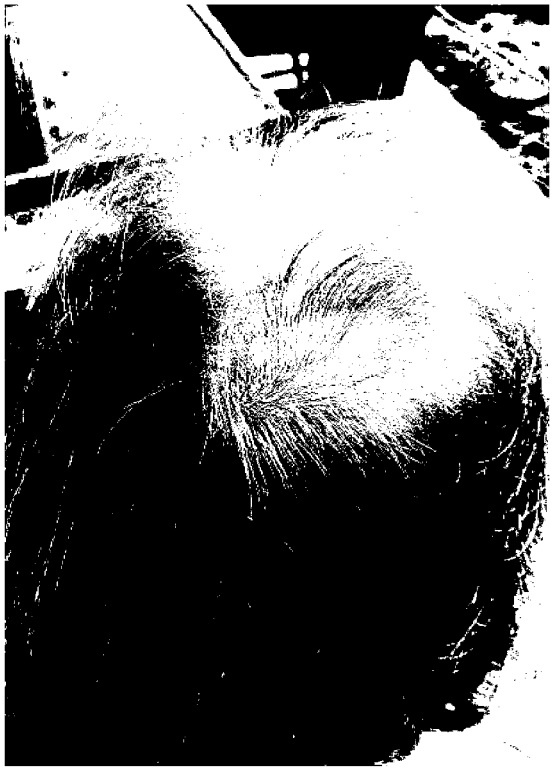
Figure 7I:
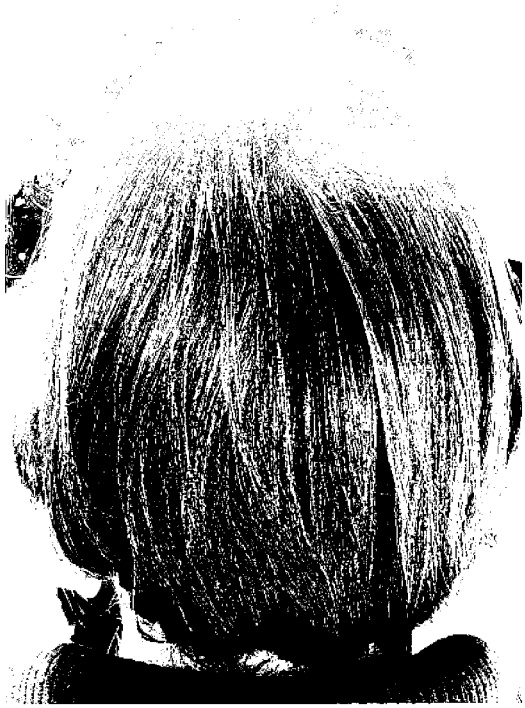
Figure 7J:
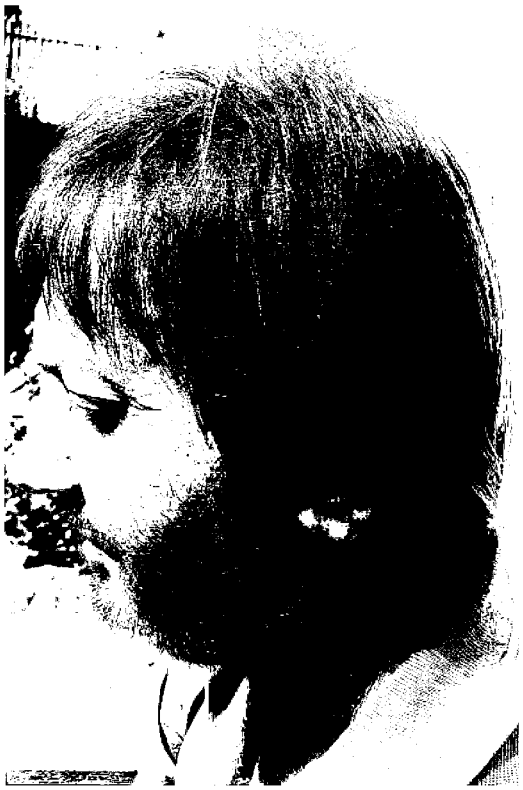

With the same subject and hair around the crown, the photograph of FIG. 7F, taken on 23 Mar. 2016, shows thin or patchy hair around the crown before the application of the method. Using the blade in approximately one square inch areas around the crown, it is seen that after about a total of eight hours work using the above-described method, FIG. 7G shows new shoots of hair growth coming through the skin of the scalp. The photograph in FIG. 7G was taken on 14 May 2016. In FIG. 7H, which shows a full back view of the hair on 20 May 2016, it is much thicker on the left side than the left side. FIG. 7I shows a photograph of the crown and the back of the head taken on 22 Jun. 2016 where the hair is more even on both sides of the head and thicker. In FIG. 7J, which is a left side view but shows part of the crown and the back of the head, this photograph was taken on 17 Sep. 2016. It clearly shows a thickening and lengthening of the hair such that there are substantially no bald or thin patches of the scalp showing through.

EXAMPLE 4

Figure 8A:
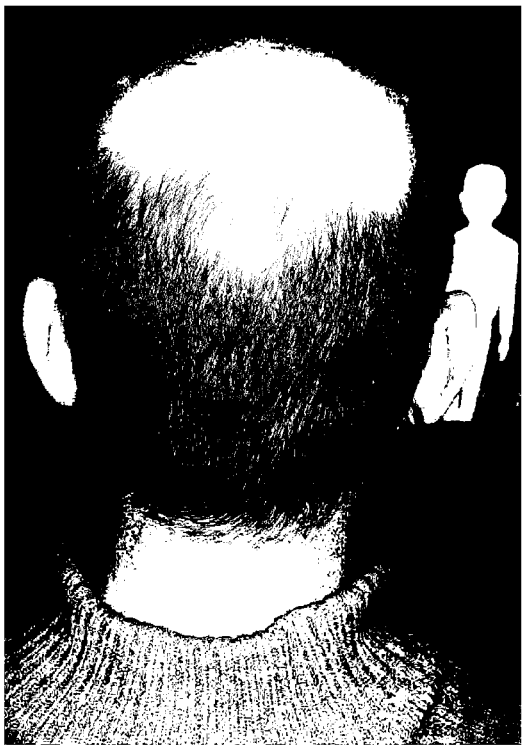
FIGS. 8A to 8E show photographs over a period of time of hair growth on the scalp of a fourth subject.
Figure 8B:
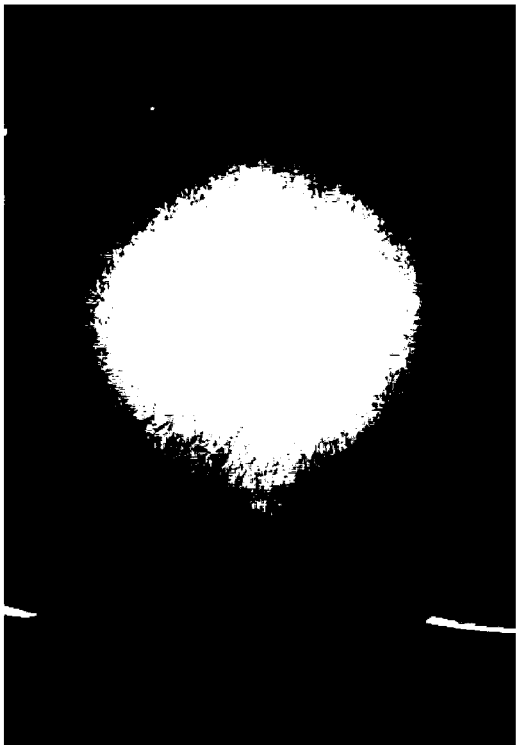
Figure 8C:
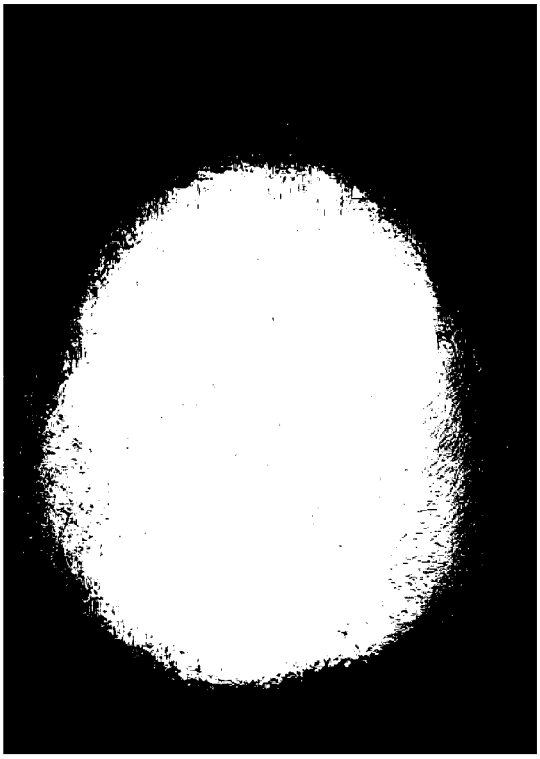
Figure 8D:
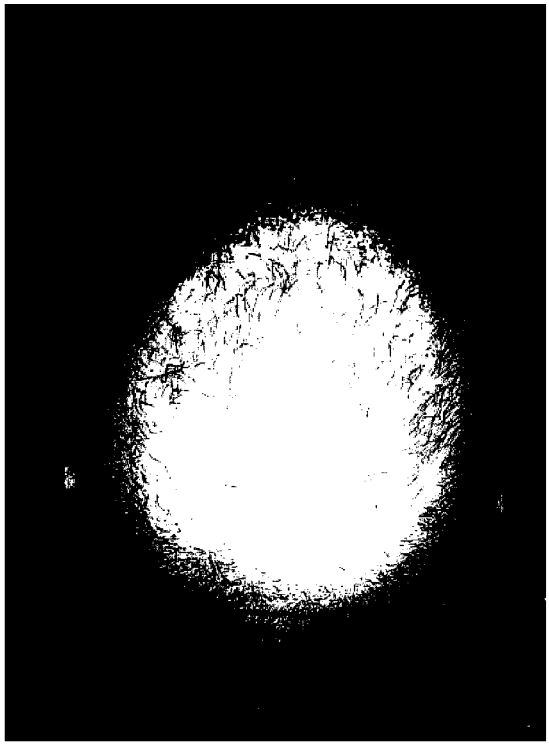

The following Figures are photographs of the scalp of a 45 year old male in which the foreline is past the crown. FIG. 8A is a photograph of the crown taken on 7 Jun. 2016 before the application of the above-described method. After a total of 12 hours of applying the above method in areas of about one square inch, the next photograph in FIG. 8B was taken on 16 Jun. 2016. It shows hair growth well inside the original foreline at the back of the head behind the crown. It also shows more shoots of new hair growth around the front part of the crown and to the right side of the crown. FIG. 8C was taken on 13 Jul. 2016 after about a total of 15 hours of using the above method over the days in between. It clearly shows additional shoots of hair from other follicles around and closer to the crown. FIG. 8D shows a photograph of the crown taken on 30 Aug. 2016 after about another six hours of work using the above method. The total amount of time spent on working on the head in this example up to 30 Aug. 2016 is about 38.5 hours from the start of the process on 7 Jun. 2016. The photograph of FIG. 8D clearly shows even more hair growth of the original shoots from around the crown and particularly just in front of the crown, from one side of the head to the other side. It also shows the further growth of the hair around the foreline at the back of the head.

Figure 8E:
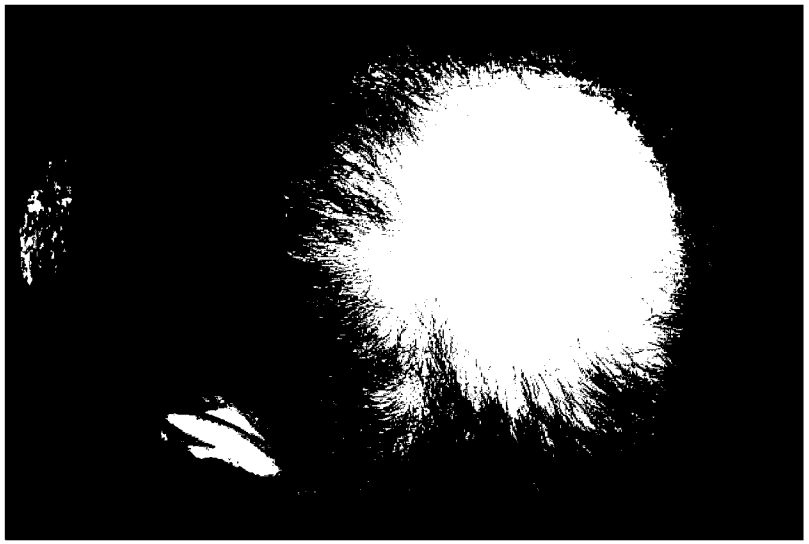

In FIG. 8E the photograph of the scalp was taken on 22 Sep. 2016 after about three weeks of non-application of the above method. The hair was allowed to grow and, as can be seen, thicker and longer hair is visible around the crown in each direction and also at least an inch above the foreline at the back of the head. Compared to the original photograph in FIG. 8A, before starting the process, there is clearly a lot more hair growing on the scalp of this person.

The invention claimed is:

1. A method of stimulating hair growth on a person's head using a device having a handle and a blade means, the method including the steps of:

moving a non-cutting edge of the blade means in a first direction and moving a cutting edge of the blade in an opposite second direction across a person's head on a first area of the head to be treated continuously for a period of time; and repeating said moving step at least once at a subsequent time until hair grows through skin of the person's head and the growth of said hair is detectable, wherein the total time of said period of time and said at least one subsequent time is at least 8 hours, wherein when said area of the head reddens due to blood circulation, the moving step is performed in a further area of the head and wherein the movement in the first direction drags the blade means across a surface of the area of the head at an angle between 40 degrees and 60 degrees, and the movement in the second direction is such that the blade means is pushed against the surface at substantially the same angle.

2. The method according to claim 1 further including positioning the blade means at an angle of between 40 degrees and 60 degrees with respect to a plane generally tangential to the surface of the area of the head where the blade means contacts the surface.

3. The method according to claim 1 wherein said first area of the head to be treated is bald.

4. The method according to claim 1 wherein said first area of the head to be treated has thinning hair.

5. The method according to claim 1 wherein said first area is up to one square inch.

6. The method according to claim 1 further including performing said moving step on another area of said head when shoots of new hair growth appear in said first area.

7. The method according to claim 1, wherein the blade means is a razor.

8. The method according to claim 1 wherein the blade means is linear and said first direction and said second direction are substantially orthogonal to the linear direction of the blade means.

9. The method according to claim 1 wherein the method is performed for between 8 and 40 hours.

10. The method according to claim 1 wherein when said area of the head reddens due to blood circulation, the moving step is performed in a further area of the head.

11. The method according to claim 1 wherein the movement in the first direction drags the blade means across the surface at an angle between 40 degrees and 60 degrees, and the movement in the second direction is such that the blade means is pushed against the surface at substantially the same angle.

12. The method according to claim 9 further includes positioning the blade means at an angle of between 40 degrees and 60 degrees with respect to a plane generally tangential to the surface of the area of the head where the blade means contacts the surface.

13. The method according to claim 9 wherein said first area of the head to be treated is bald.

14. The method according to claim 9 wherein said first area of the head to be treated has thinning hair.

15. The method according to claim 9 wherein said first area is up to one square inch.

16. The method according to claim 9 further including performing said moving step on another area of said head when shoots of new hair growth appear in said first area.

17. The method according to claim 9, wherein the blade means is a razor.

18. The method according to claim 9 wherein the blade means is linear and said first direction and said second direction are substantially orthogonal to the linear direction of the blade means.

19. The method according to claim 9 wherein when said area of the head reddens due to blood circulation, the moving step is performed in a further area of the head.

20. A method of stimulating hair growth on the scalp of a person's head using a device having a handle and a blade means, the method including the steps of:

contacting the blade means on a first area of the scalp;

moving the blade means in a continuous reciprocating motion on the scalp comprising moving a non-cutting edge of the blade in a first direction and moving a cutting edge of the blade in an opposite second direction across the scalp of a person's head for a first period of time to exfoliate skin on the first area, wherein the blade means remains in continuous contact with the scalp during the reciprocating motion until hair growth is detected in the first area.

21. The method according to claim 20 wherein the method is performed for between 8 and 40 hours.

22. The method according to claim 20 wherein the movement in the first direction drags the blade means across the surface at an angle between 40 degrees and 60 degrees, and the movement in the second direction is such that the blade means is pushed against the surface at substantially the same angle.

* * * * *